United States Patent [19]

Torok et al.

[11] 4,317,956

[45] Mar. 2, 1982

[54] REMOTE CHALKBOARD AUTOMATIC CURSOR

[75] Inventors: Gabor P. Torok, Holmdel; Andrew B. White, Marlboro, both of N.J.

[73] Assignee: Bell Telephone Laboratories, Incorporated, Murray Hill, N.J.

[21] Appl. No.: 205,634

[22] Filed: Nov. 10, 1980

[51] Int. Cl.[3] ..... G08C 21/00; G08B 23/00

[52] U.S. Cl. ..... 178/18; 340/709

[58] Field of Search ..... 178/18, 19, 20, 30; 340/152 R, 152 T, 705, 708, 709, 710, 716, 721; 33/1 M; 358/295

[56] References Cited

U.S. PATENT DOCUMENTS 3,609,749 9/1971 McClelland .
3,651,508 3/1972 Scarborough, Jr. et al. .
3,706,850 12/1972 Fisher et al. .
3,739,347 6/1973 Forsberg .
3,852,721 12/1974 Tucker et al. .
3,949,391 4/1976 Benjamin .
3,959,585 5/1976 Mattes et al. .
4,117,471 9/1978 Schlig et al. .
4,125,743 11/1978 O'Boyle et al. .

*Primary Examiner*—Thomas A. Robinson
*Attorney, Agent, or Firm*—David H. Tannenbaum

[57] ABSTRACT

A telautograph system allows a user at one location to write on a special surface, such as a chalkboard, and have the image appear at remote screens. Presently, a user wishing to call attention to an entry already written on the board must make a new line or must circle the item to which the remote viewer's attention is to be drawn. This procedure unduly clutters the image and a system has been devised which provides for a cursor (a graphical hand) to appear on the remote screen when the user touches the input surface at a point. The cursor also appears when the user is writing on the surface so as to call attention to the newly formed images. When pressure on the writing surface is released the cursor remains on the remote screen for a finite period and then automatically disappears, leaving the image unencumbered. When information is being removed from the input surface a graphical eraser appears at the remote screen at the site of the removed information.

21 Claims, 10 Drawing Figures

FIG. 1
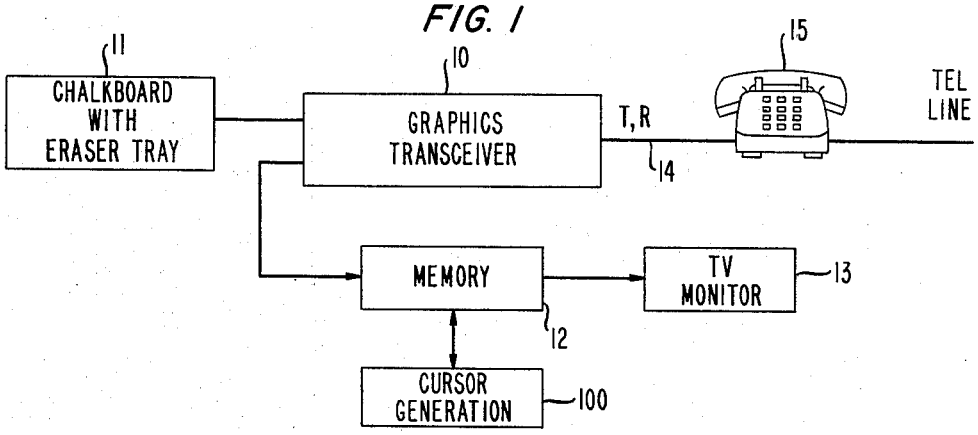
FIG. 2
$x^2+ax+bx+ab=0$
$(x+\quad)(x+b)$
FIG. 3
$x^2+ax+bx+ab=0$
301
$(x+a)(x+b)$
FIG. 4
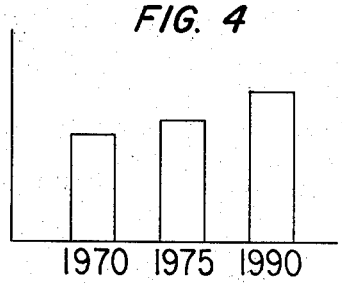
FIG. 5
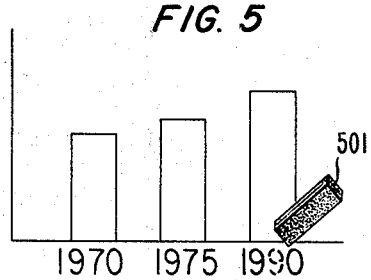
FIG. 6
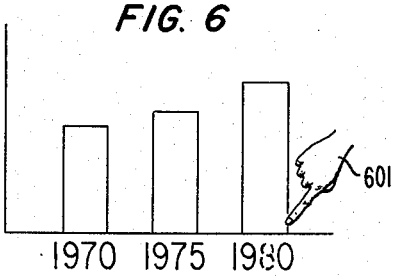

REMOTE CHALKBOARD AUTOMATIC CURSOR

FIELD OF THE INVENTION

This invention is directed to remote graphic communication and more particularly to an arrangement for providing a temporary image to assist the remote viewer when the information is changing.

BACKGROUND OF THE INVENTION

Remote graphic communication, particularly in the form of remote chalkboards, is gaining popularity. Such systems, sometimes called telautograph systems, allow persons at an input chalkboard to write on the board in the conventional manner. An image of the written material will then appear on the remote viewing screen. Such systems are particularly helpful in lectures where classrooms may be distributed around the country or around the world. One such system is shown in the G. M. C. Fisher, U.S. Pat. No. 3,706,850, dated Dec. 19, 1972. An example of the surface which is used to accept the input is shown in U.S. Pat. No. 3,959,585, dated May 25, 1976, issued to H. C. Mattes. These two patents are hereby incorporated by reference as though they had been reproduced herein in their entirety.

While telautograph systems serve their intended purpose, a practical problem remains to be overcome. In operation, as a lecture progresses the remote chalkboard becomes filled with information, such as equations or graphs. Usually, at some point, the lecturer wishes to highlight some previously written symbol. From the local or transmitting end, this simply requires the lecturer to place the chalk or stylus next to the location on the chalkboard where the listeners' attention should be focused. Viewers at the local end then known precisely where the lecturer is pointing. However, at the remote end, the viewers do not have the benefit of seeing the lecturer and thus must rely strictly on their ability to locate a dot, i.e., the point at which the lecturer is touching the surface of the sending screen. Under the best of conditions, this would be difficult. However, because of transmission and screen resolution problems where random background dots are not uncommon, it is virtually impossible for a remote end viewer to know where a lecturer is pointing. Thus, the viewer must struggle to follow the lecturer.

The lecturer, on the other hand, knowing that the remote viewer cannot see the chalk's position, will typically circle the point on the board where attention should be directed. However, once circles, squares and other extraneous materials begin to appear on the screen the information content can become degraded to the point where the whole purpose of the remote transmission can become lost.

This same problem, or a variation thereof, is evident when the lecturer tries to erase or correct a small portion of the board. The viewer must scan the entire remote screen trying to see what letter, number, exponent, or punctuation has changed. Under these conditions, what begins as an aid to communication quickly becomes a hindrance.

As a possible solution to these problems those familiar with graphic terminals will focus their attention on known cursor systems where the cursor marks the position of the input. Typically, however, such cursor systems are arranged to either (1) locate for a person at a terminal (user) the position of the next mark to appear on the screen, or (2) allow the user to move the cursor over the face of the screen thereby locating a point on the screen at which some future action (usually by the machine) is to be taken. In these situations, the cursor is either used as an aid to the user or as an aid to the machine. In the first situation, the machine generates a cursor at the next anticipated screen position and in the second instance the user generates the position manually. In neither of these situations is the cursor arranged to assist either a remote viewer or a lecturer in solving the problems discussed for telautograph systems.

SUMMARY OF THE INVENTION

We have solved the above discussed problems in a manner which allows the lecturer complete freedom to lecture in a natural manner without in any way requiring a change in the lecturer's actions. From the remote viewers' standpoint, the problem of knowing where the chalk is resting, or knowing which marks are being added and which marks are being changed, is solved by an arrangement which generates a graphical symbol, as an overlay, on the remote screen at the site of the activity. This overlay automatically appears on the screen at the proper place and remains on the screen only as long as the activity at the sending end continues. Thus, while the lecturer is writing at the sending end, both a reproduction of the writing and a graphical overlay (for example, a hand) appear on the remote screen. The "hand" automatically moves along with the written words. When the lecturer stops writing, the hand disappears from the screen. For erasure situations, a graphical "eraser" appears over the symbol being removed.

In one embodiment, the hand may be arranged to remain visible for a certain period after the removal of the chalk or stylus at the sending end. In another embodiment, it is possible to have the hand only appear for small changes. For continuous writing, the graphical hand would disappear; the theory being that in such a situation the writing itself serves to identify for the viewer where the change is taking place.

This system has the advantage that the generator overlays can be selected in a manner such that they appear in phantom thereby not interfering with the writing which appears "beneath" the symbol. The electronics can be designed in such a manner that the "eraser" symbol will vibrate and appear to rub out the appropriate mark. We have, by use of automatically generated graphics, created an environment which solves the problems of both the lecturer and the viewer by allowing each to function in a natural manner, with the electronics acting to bridge the information gap between them. This solution is elegant in that it solves the problems without the addition of expensive hardware and with little, if any, additional overhead cost in the software.

BRIEF DESCRIPTION OF THE DRAWING

The invention and its several other objects, features and advantages will be more readily understood from a reading of the description to follow taken in conjunction with the drawing.

FIG. 1 is a block diagram of a typical telautograph system;

FIGS. 2–6 are sketches showing various remote screen images;

GENERAL DESCRIPTION

Figure 7:
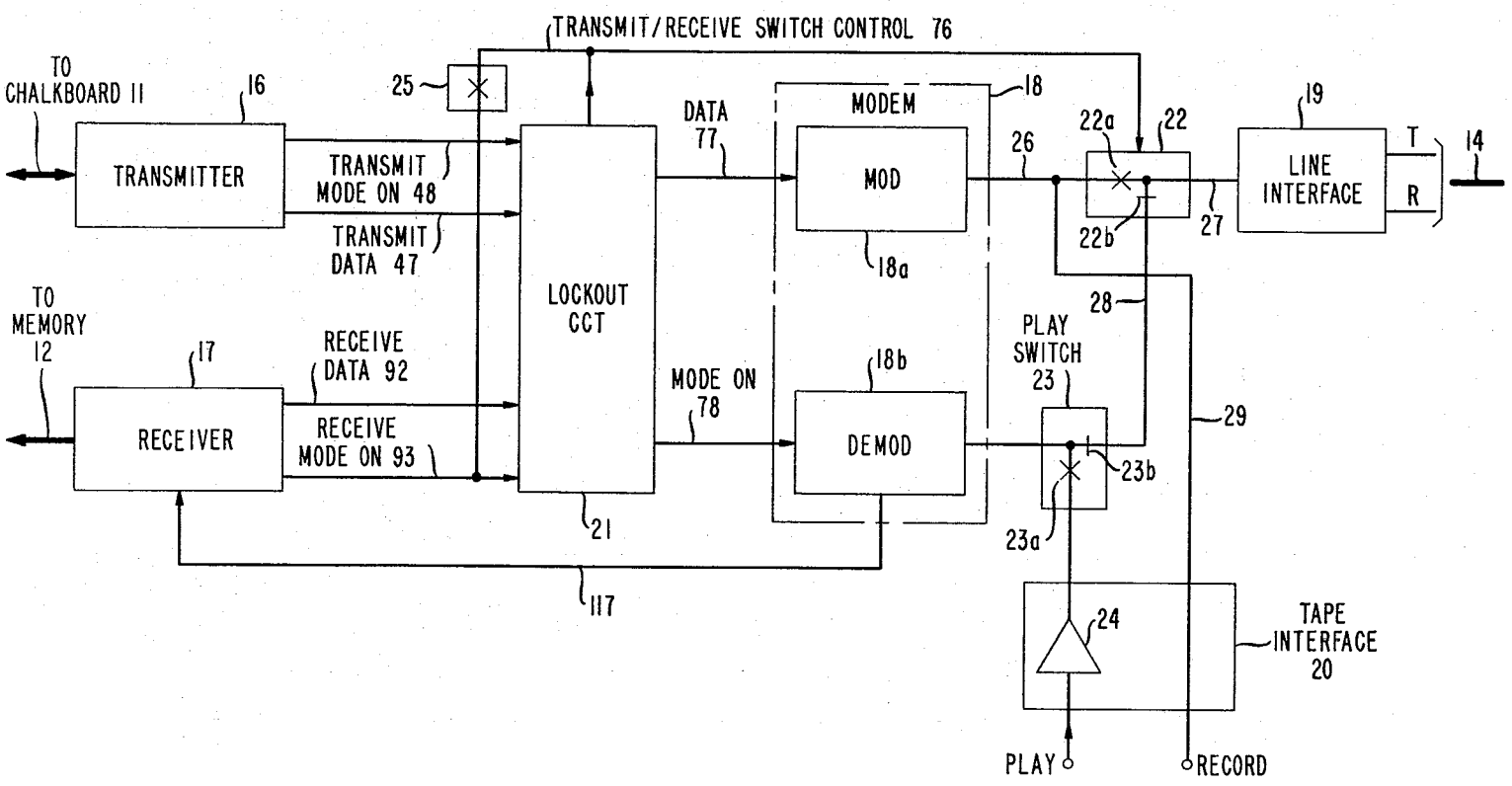
FIG. 7 is a block diagram of the graphics transceiver.

FIG. 1 depicts a typical graphics system in accordance with the present invention, consisting of a transceiver 10, electronic chalkboard 11, memory 12, and TV monitor 13, all connected to a telephone line 14 that may include a standard telephone set 15. The telephone line may extend to a PBX or CO and may be connected to transceiver 10 directly. Images drawn on chalkboard 11 appear on the visual screen of TV monitor 13. While only one end of the system is shown in FIG. 1, it is understood that the system shown is bidirectional and that a TV monitor would be located at the remote end with the data signals being transmitted over conventional communication facilities. Typically, a system would be configured with the sending location arranged as shown in FIG. 1 and the remote location arranged only with a visual output display.

Transceiver 10, shown in further detail in the block diagram of FIG. 7, includes transmitter 16 connected to one or more electronic chalkboards, receiver 17 connected to one or more conventional memory units, modem 18, which for example, can be a Bell System 202 type connecting transmitter 16 and receiver 17 to telephone line 14, and lockout circuit 21 for normally maintaining transceiver 10 in a receive mode. One such transceiver is shown in L. E. O'Boyle, U.S. Pat. No. 4,125,743, dated Nov. 14, 1978. A conventional line interface 19 is provided between modem 18 and line 14. A tape recorder/reproducer may also be connected to the system through tap interface 20.

Figure 8:
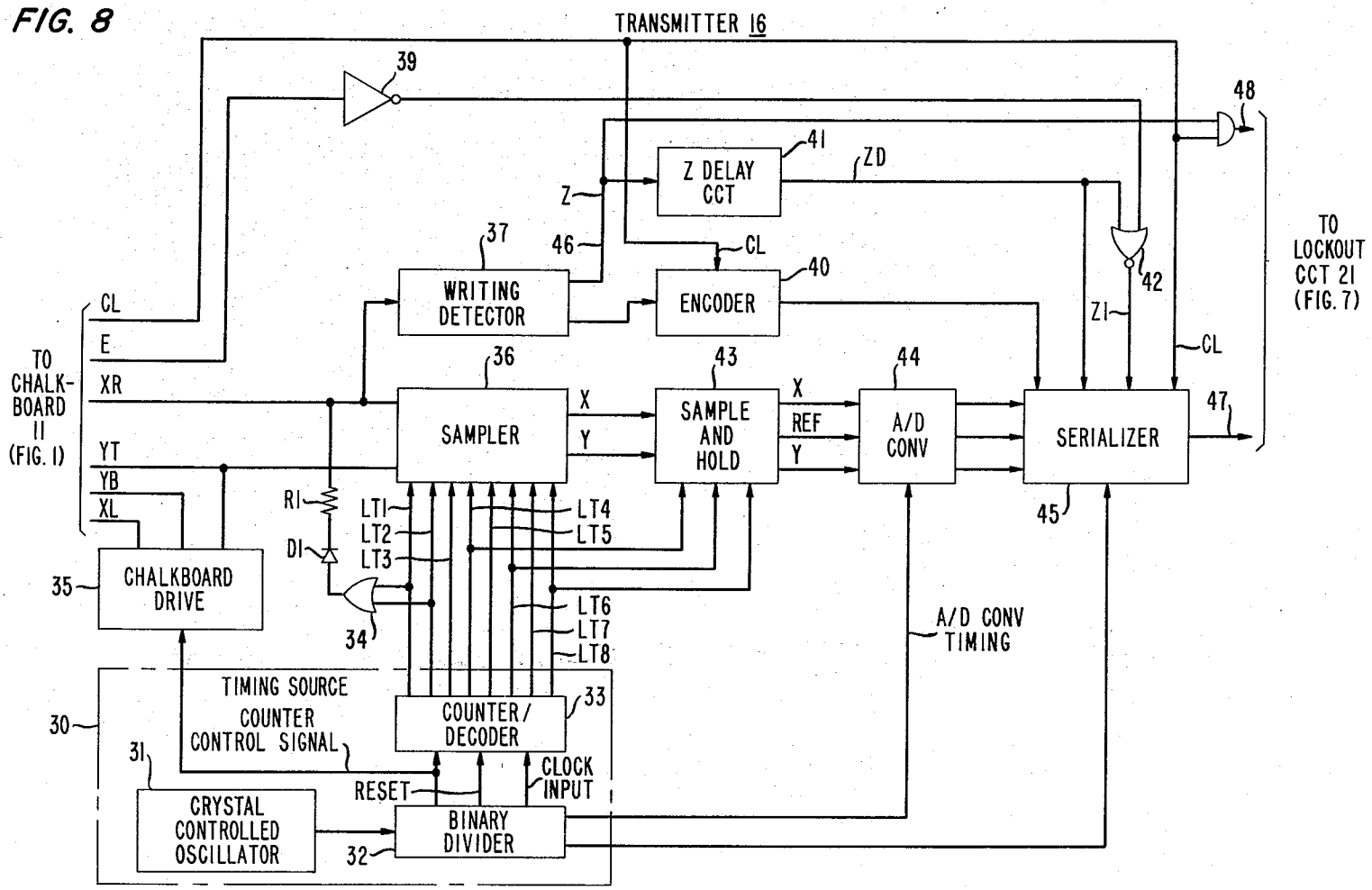
FIG. 8 is a block diagram of the transmitter.

Transmitter 16, shown in FIG. 8 includes timing source 30, chalkboard drive 35, sampler 36, writing detector 37, modem transmit control 48, Z delay circuit 41, sample and hold circuit 43, analog-to-digital converter 44 and serializer 45.

Timing source 30 (FIG. 8) comprises conventional crystal controlled oscillator 31, binary divider 32, and counter/decoder 33. In addition to other output signals, binary divider 32 generates the necessary clock input, reset signals to drive counter/decoder 33 which divides the signal into eight discrete and equal time slots T1 through T8 and generates pulses representative of these time slots via output leads LT1 through LT8, respectively.

Detection of Writing

As shown in the aforementioned Mattes patent the input terminal (chalkboard) consists of two separated sheets shown as the X sheet and Y sheet. Detection of writing on chalkboard 11 is determined during time slots T1 and T2 (FIG. 8) when a +5 voltage gradient is applied across the Y sheet and the X sheet is driven to a larger voltage of +12 volts via OR gate 34, which is activated by timing pulses T1 and T2 on leads LT1 and LT2. If writing or erasing is not occurring on the chalkboard, no contact is made between the X and Y sheets, and the voltage on the X sheet (as measured on lead XR) will rise to +12 volts. If pressure is applied via an eraser or chalk, contact is made between the sheets and the voltage on the X sheet will then be forced to be between 0 and +5 volts by the Y sheet.

Continuing in FIG. 8, OR gate 34 drives the X sheet of chalkboard 11 via diode D1 and resistor R1, the resistance of R1 being substantially greater than the resistance of the X sheet. Hence, should a voltage differential occur as a result of contact between the X and Y sheets, most of the voltage drop will occur across resistor R1 so that the X sheet will have a voltage approximately that of the Y sheet where contact is made. A comparator in writing detector 37 compares the voltage of the X sheet on terminal XR to some reference voltage, say +6 volts. If the voltage of the X sheet is less than +6 volts, a high output Z signal is generated to indicate that either writing or erasing is occurring on chalkboard 11.

This signal indicative of an informational change at the input terminal is transmitted to lockout circuit 21 over lead 48 to put transceiver 10 in the transmit mode. At the same time, the high Z signal is further processed with NOR gate 42 to generate either a write or erase command Z1 for transmission.

Determination of Chalk Position

During the Y-drive time slots T3 and T4, the X sheet of chalkboard 11 is floating. If contact is made the X sheet will then assume the voltage of the Y sheet at the point of contact. This voltage, of some value from 0 to +5 volts, represents the Y position of the chalk on the chalkboard. Because a voltage gradient is applied across the Y sheet, i.e., +5 volts at a top terminal and 0 volts at a bottom terminal, the ratio of the voltage measured with respect to +5 volts is proportional to the ratio of the distance between the bottom of Y sheet and the point of contact to the total height of the Y sheet. Hence, sampling the X sheet at time slot T4 will generate a voltage representing the chalk's Y position at that time. A reference voltage of approximately +5 volts is applied to lead XR during time slots T5 and T6. This voltage is sampled by sampler 36 during time slot T6 to yield the voltage, REF, representing the maximum X or Y position to provide a reference for the X and Y position voltage samples during analog to digital conversion.

During the X-drive time slots T7 and T8 Y sheet is floating and the Y sheet assumes the voltage of the X sheet at the point of contact. This voltage, also of some value from 0 to +5 volts, represents the X position of the chalk on the chalkboard. Because a voltage gradient is applied across the X sheet, i.e., +5 volts on a right terminal of the X sheet and 0 volts on a left terminal, the ratio of the voltage measured with respect to +5 volts is proportional to the ratio of the distance between the left side of the chalkboard and point of contact to the total width of the X sheet. Hence, sampling the Y sheet during time slot T8 will generate a voltage representing the chalk's X position.

The sampled X, Y, and REF signals are then stored for subsequent A to D conversion in conventional sample and hold circuit 43. The sample and hold X and Y outputs are converted into digital form using a conventional dual-slope A-D converter 44. The reference output REF of the sample and hold circuit 43 is used as a reference for A to D converter 44.

Partial Erase Mode

As mentioned earlier, pressure made on a chalkboard can be interpreted as writing or erasing. For erasure of portions of writing pressure presumably made by an eraser removed from its tray is advantageously transmitted with positional data to delete the corresponding information from the displayed image.

The eraser tray of chalkboard 11 is provided with an eraser. An LED light source that advantageously is infrared in wavelength, is placed in line with a photodetector. Normally, the eraser blocks the passage of light, but when the eraser is removed from the tray, a light path is established and the photodetector is turned on producing a low output signal on lead E. The E signal is inverted via inverter 39 (FIG. 8) and applied to NOR gate 42 to place transmitter 16 in a transmit erase mode.

Transmit Clear Mode

When chalkboard 11 is being erased entirely of all graphics information, a clear switch located on the eraser tray is manually depressed to send a logical high clear signal via lead CL to transmitter 16 putting the transmitter in a transmit clear mode. When received the clear mode signal erases the image stored in memory 12.

Half-Duplex System Operation

Pursuant to a further feature of the invention the system is normally maintained in a receive mode. For example, when chalk touches the chalkboard, lockout circuit 21 is called into play and prevents writing from being received from a distant terminal as long as writing continues locally. Also, lockout circuits at the distant stations prevent their associated transceivers from transmitting whenever writing is received. This is done by forcing the remote transceivers to stay in receive mode.

Referring to FIG. 7, lockout circuit 21 is a conventional transfer switch which is controlled by the state of transmitter 16 and receiver 17 via leads 48 and 93, respectively.

When the Z or CL signal goes high (writing or erasing is occuring on the chalkboard) a high level on lead 48 signals lockout circuit 21 to place the transceiver in the transmit mode. If the receive mode on lead 93 is low, modulator 18*a* is turned on by lead 78. In addition, lockout circuit 21 connects modulator 18*a* to line interface 19 with a high signal on switch control lead 76 which closes contact 22*a* and opens contact 22*b*. Until lead 48 goes low, transmit data from transmitter 16 on lead 47 is passed to modulator 18*a* via lead 77 and is transmitted to communication line 14 by contact 22*a* and line interface 19. At the same time, the receive data to demodulator 18*b* via lead 28 and switch 22 is blocked.

If a properly formatted signal is received by receiver 17 from telephone line 14 via demodulator 18*b* and lead 117 before writing occurs on the local chalkboard, receive mode on lead 93 will go high. This high signal output from receiver 17 blocks transmit lead 48 and 47, which prevents transceiver 10 from entering the transmit mode. The modulator 18*a* output on lead 26 cannot be connected to the communication line since the transmit/receive switch 22*a* is open when in the receive mode.

Receive Mode

Figure 9:
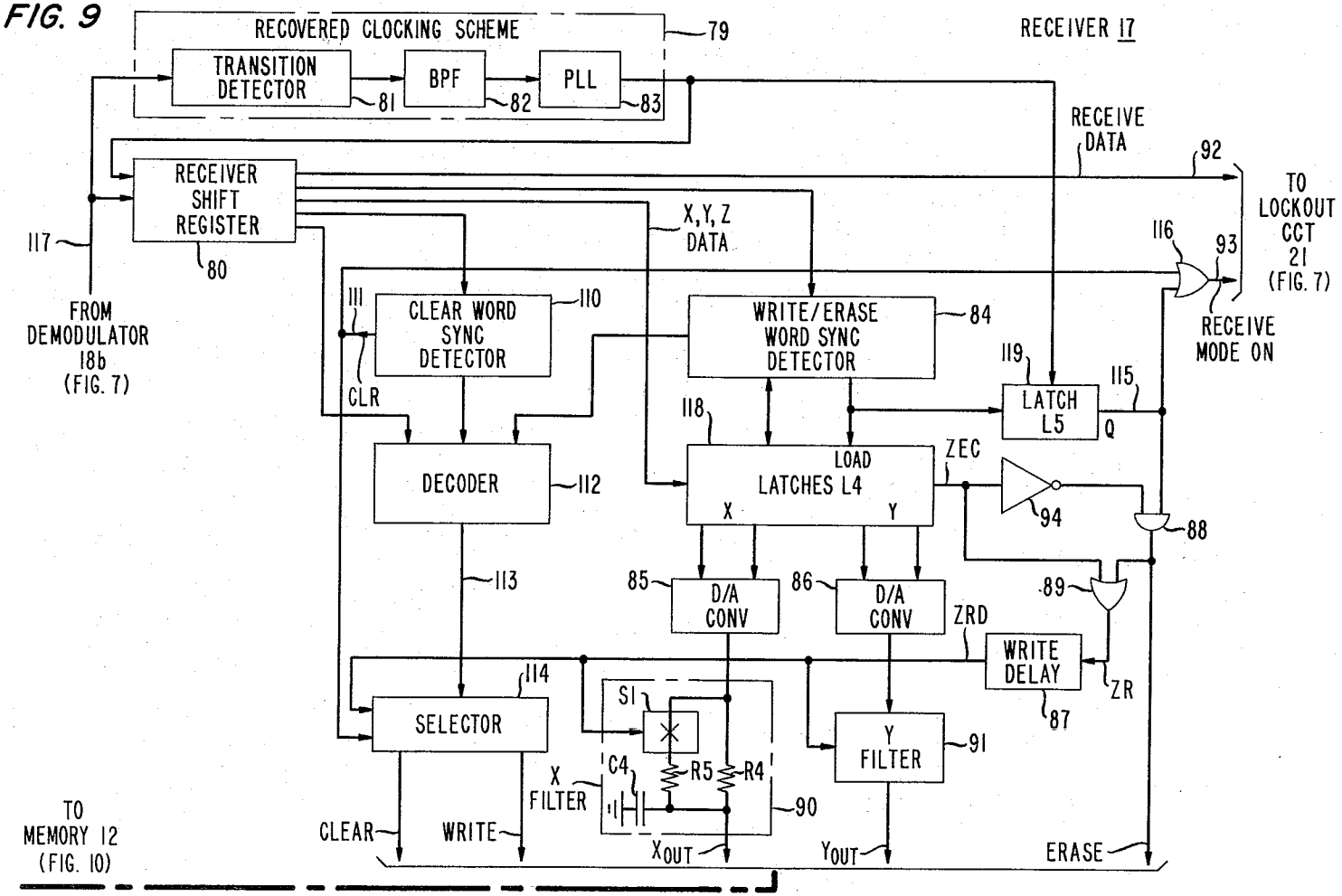
FIG. 9 is a block diagram of the receiver.

Referring to FIG. 9, receiver 17, upon receiving data from demodulator 18*b* over lead 117, clocks the data through receiver shift register 80 with the recovered clock from lead 79. Conventional word sync detector 84 then examines the receive data from the shift register 80 for the presence of sync characters which indicate whether write or erase mode commands have been received. Clear word detector 110 examines the input data for the presence of clear mode commands.

Clear word detector 110, in practice, looks for at least four consecutive clear commands before generating a high clear signal CLR on lead 111. Lead 111 connects to lead 93 of lockout circuit 21 via OR gate 116 and to a selector 114. Selector 114 generates a CLEAR signal for memory 12 if CLR is high and ZRD is low.

Assuming that a distant transmitter is writing or erasing data, the sync characters will cause a high output from word sync detector 84, which in turn signals latches L4 to load the X, Y, Z data. At the same time latch L5 is activated to generate a high output on lead 115 and, in turn, on lead 93 via OR gate 116, which signals lockout circuit 21 that demodulator 1*b* in transceiver 10 is receiving a valid data transmission. The ZR output from OR gate 89 is high whenever the receive data indicates an active WRITE or ERASE.

A low signal on the L4 output ZEC signals an erase mode command by causing the ERASE output of AND gate 88 to go high while forcing the ZR output of OR gate 89 high. Both of the write and erase commands cause ZRD to go high, however ERASE is only high during an erase command.

A high level signal on ZEC signals a write command. ZR is forced high by OR gate 89 and ZRD goes high after a delay generated by WRITE Delay 87. ZRD combined with the output of decoder 112, generates a WRITE signal from selector 114 which causes new data to be written into memory 12 at the location specified by the X and Y outputs of latch L4.

A high signal on ZR indicates that either a write or erase command has been received.

Avoiding Distortion at Receiver

The write command ZR is delayed by write delay 87 to avoid distortion of the writing on display 13 in the following way. The received X and Y data are each converted into an analog form by the corresponding D to A converters 85, 86, and then are applied to corresponding dual mode reconstruction filters 90 and 91.

Dual mode filters 90 and 91 are identical to each other and comprise parallel resistors R4 and R5 that are connected to capacitor C4. Resistor R4 (20 kilohms) is substantially larger than resistor R5 (200 ohms). Filter 90 is controlled via switch S1 and lead ZRD causing the filter to operate in either a short or long time constant mode.

When the delayed write command ZRD goes low, filters 90 and 91 are switched to the fast mode. The filter switch S1 (and the switch in filter 91—not shown) shorts the larger resistor R4, to produce a filter having a relatively fast response time. When the write command ZR signal goes high, switch S1 of filter 90 opens so that the filter operates in the slow response mode.

ZRD is generated by ZEC after a delay of approximately twelve milliseconds in write delay circuit 87. During this time filters 90 and 91 quickly respond to the initial X and Y voltages the location where writing or erasing will begin when the delayed write comand ZRD goes high. After the delay time, filters 90 and 91 are switched to their slow time constant and provide a smoothly changing output between the received samples. Advantageously, write command ZR turn off is also delayed by delay circuit 87 to make allowance for the inherent delay in reconstruction filters 90 and 91. Without this delay, completion of reconstruction would occur after the write command ZR turns off and would cause the last portion of writing or erasing to be skipped.

Returning to FIG. 1, the cursor generation circuitry is shown combined with a digital frame memory 12 for the electronic chalkboard system. While a modified electronic chalkboard system transceiver could be employed to drive the cursor generation circuitry directly, the most straightforward implementation uses the signal processing circuitry contained in the digital memory unit 12. As will be seen this association allows a precise correlation between the position of the cursor and the actual data entered into the digital image memory.

In FIG. 2 there is shown a portion of the remote screen that depicts a chalkboard upon which the lecturer has written an equation which must be factored. The second line of FIG. 2 shows a blank within the first bracket. Using our invention the lecturer indicates the location in the display where he wishes attention to be focused simply by touching the chalk, a pointer, or a finger to that point which would cause a cursor image to appear. Alternatively, the lecturer could write the missing information, as shown in FIG. 3, whereupon the system automatically generates graphical cursor 301 (hand in our example) at the proper location. The "hand" remains as long as contact is maintained on the chalkboard. The cursor can be arranged to remain visible for a period of time after pressure has been released.

In FIG. 4 there is shown a graph where the last block contains the number "1990". The lecturer has determined that this number is incorrect and using the chalkboard eraser, removes the "9". This is shown in FIG. 5 where graphical cursor 501 (an eraser) is overlayed at the point where the "9" is being erased from the display image. In FIG. 6 a graphically generated hand 601 follows the motion of the lecturer as the new number is entered.

Detailed Description of the Cursor Generation Arrangement

Figure 10:
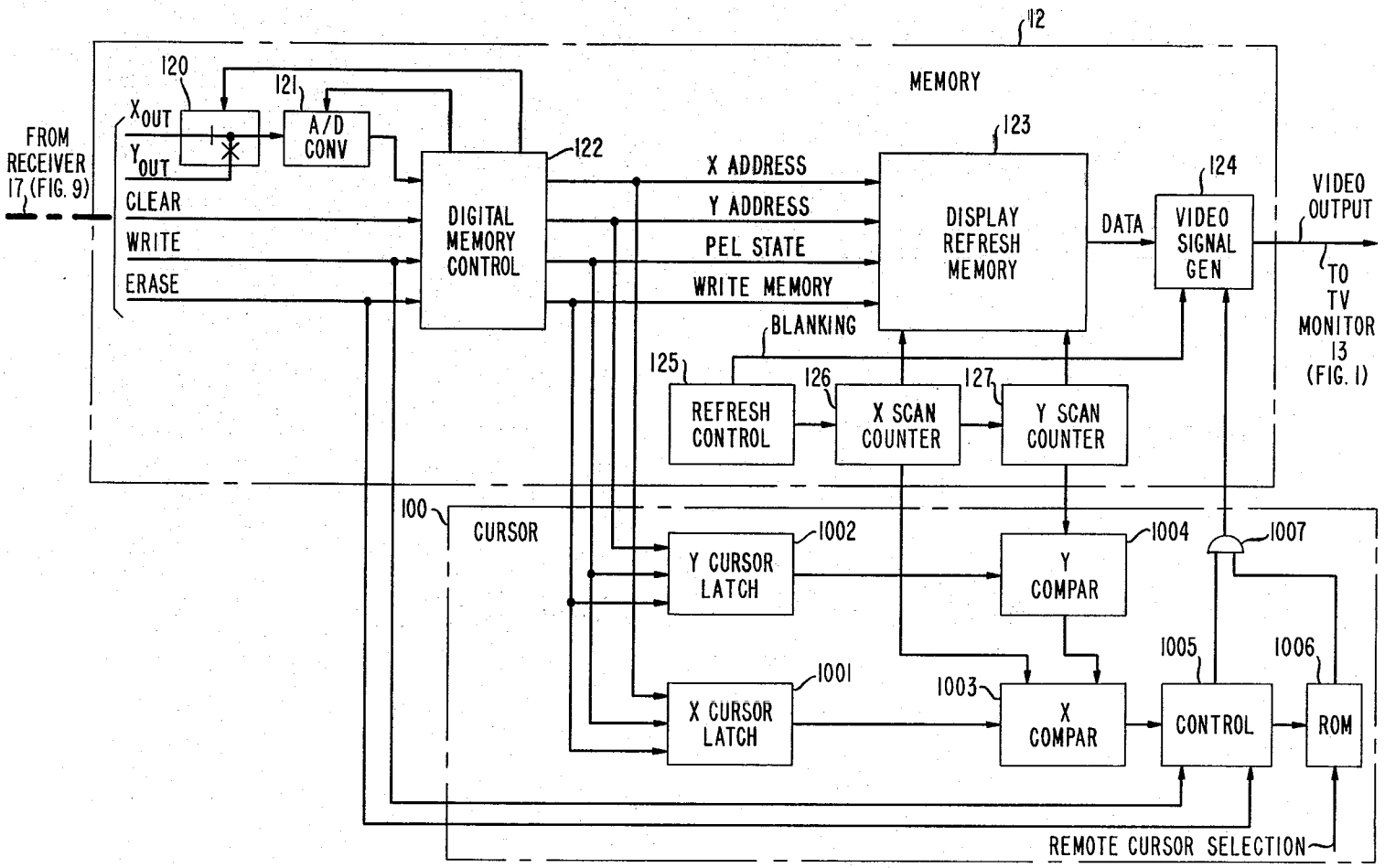
FIG. 10 shows the memory and cursor control circuits.

Cursor generation circuitry 100 shown in FIG. 10 is composed of three major sections. The cursor X-Y position latches, 1001, 1002; scan address comparators 1003, 1004; and cursor image generation circuitry, 1005, 1006. As will be seen the basic operation of this circuitry is that the X, Y address of a point written into or erased from the display memory is latched into the cursor location registers by the same signal that writes data into digital image frame memory 123. This stored address, or position, is compared with the output of the counters used to scan the digital memory and refresh the image on the CRT display. When the refresh scan reaches the location of the last picture element written into the memory and either a write or erase signal is present, the cursor circuitry is enabled so that a visible cursor overlay is generated. This cursor overlay is combined with the video output of the digital memory in 124 for display on the electronic chalkboard video monitor. While drawing on the chalkboard, the cursor that is displayed could be an image of a hand and during the erasure operation, the image could be that of an eraser. Both cursor images are visible while the chalk or eraser is in contact with the transmitting electronic chalkboard.

Memory unit 12 (FIG. 10) receives five signals from the graphic transceiver shown in FIG. 9. These signals are CLEAR, WRITE, ERASE, and two analog signals Xout and Yout. These last two signals are analog voltages between 0 and Vmax which represent the location of the chalk or the eraser while the transmitting site is either drawing or erasing on the electronic chalkboard. The WRITE signal is enabled when the remote user is drawing with the chalk, and the ERASE is enabled while erasing. The CLEAR signal is not used by the cursor generation circuit.

The Xout and Yout signals are digitized by A/D converter 121 to uniquely identify a bit in the digital refresh memory 123. These inputs are sampled at least 5000 times per second. The 0, 0 address for the display memory is in the upper left hand corner of the image. If WRITE is enabled, an energized or 1 bit is written into the digital memory at the digitized X, Y location of each sample. Concurrently, the same address is loaded into the X cursor and Y cursor latches, 1001 and 1002, to determine the location of the latest data change. When the ERASE signal is enabled, a bit in the digital memory is cleared or set to 0. Each time a bit is cleared, the address of that erased bit is loaded into the X cursor and Y cursor latches, 1001, 1002.

To display the stored image on a CRT monitor, the image must be refreshed from the digital memory at least 30 times per second. Refresh controller 125 uses the Xscan and Yscan counters, 126, 127, to access each bit in the digital display memory to provide an output which is an (ON) signal for re-energization and an (OFF) signal for no re-energization. Comparison circuit 1004 continuously compares the value of Yscan counter 127 with the value contained in the Ycursor latch 1002 to determine when to enable the cursor overlay. When this comparator determines that the Yscan address is higher than the Ycursor address, an enable signal is sent to Xcursor comparator 1003. Once enabled, Xcursor comparator compares the value of Xscan counter 126 with the Xcursor latch 1001. When the Xscan location is greater than the value stored in 1001, the cursor generation circuitry 1005, 1006 is enabled to generate the cursor image overlay at the location stored in latches 1001 and 1002.

Read only memory (ROM) 1006 contains at least two independent cursor images: one for drawing and the other for erasing. If WRITE is enabled, the bits representing the drawing cursor are addressed only if ERASE is enabled the erase cursor image bits are addressed. To determine the correct horizontal scan line of the cursor image, control circuit 1005 subtracts the value stored in Xcursor 1001 from the address presented by Xscan 126 and the address in Ycursor 1002 from Yscan 127. For reference purposes the upper left hand corner of the cursor image is the X, Y location stored in Xcursor and Ycursor.

The bit output of cursor generation ROM 1006 is combined with the image data output of the digital memory in video signal generator 124 for presentation to the video monitor. The cursor overlay is independent of and does not alter the contents of the display image frame storage memory. When the WRITE signal is disabled, a delay circuit in cursor control circuitry 1005 holds the image of the cursor on the display for a short period of time before turning off the cursor image. When the ERASE signal is disabled, the cursor disappears immediately.

In normal operation, the WRITE cursor moves smoothly while writing new data into the memory. In a typical electronic chalkboard system, the graphics transceiver adds a jitter to the Xout and Yout signals during an ERASE operation. The cursor control circuitry can be designed to use this jitter to cause the erasing cursor to move about as though it were erasing a small area in the display image. An alternative is to ignore this small amount of jitter and present a smoothly moving erasing cursor centered on the erase area.

In some applications it may be desirable to generate the cursor with an intensity different from that of the display image to enhance the cursor visibility. The configuration of the cursor can be changed by simply changing the bit patterns stored in the cursor image generation ROM 1006. Any degree of sophistication can be achieved by using a ROM with different bit patterns selectable either manually or automatically for different operations. Thus, it would be possible to allow the viewer a choice of graphic cursors some of which could be in color. One implementation of such a selection could be by storage of the graphical bits in different ROM sections, each selectable remotely.

Another implementation of remote cursor selection could be to employ a unique cursor overlay for each one of several remote chalkboard locations. In this implementation an additional set of outputs from decoder 112 (FIG. 9) and 114 could reflect the source of a remote writing or erase signal in a fashion similar to the technique described in the aforementioned O'Boyle patent to determine which of three chalkboards is the source of new write or erase commands. Each remote location could be represented by a different writing cursor overlay so that a viewer would know immediately which location is transmitting new information. The remote location could be distinguished by the cursor overlay shape or color or a combination of both.

We claim:

1. A display system having a sending unit and a viewing unit for displaying images created at said sending unit, characterized by means for displaying a selective distinctive graphic image at positions on said viewing unit corresponding to positions where said images are being changed on said sending unit.

2. The invention set forth in claim 1 wherein said displaying means includes means for removing said distinctive graphic images when image on said viewing unit are unchanging.

3. The invention set forth in claim 1 wherein a first one of said distinctive graphic images represents the addition of an image to said viewing unit and a second one of said distinctive graphic images represents the removal of an image from said viewing unit.

4. The invention set forth in claim 3 wherein said displaying means includes means for selectively removing said provided graphic images when images on said viewing unit are unchanging said means being operable to remove said second image immediately upon the cessation of said erasing and operable to remove said first image a fixed time interval after the cessation of said writing.

5. The invention set forth in claim 1 wherein a first one of said selected distinctive graphic images represents the change of an image at a first one of said sending units and a second one of said selected distinctive graphics images represents the change of an image at a second one of said sending units.

6. The invention set forth in claim 1 wherein said displaying means includes a read only memory (ROM), the bit patterns of which are used to form said distinctive graphic image.

7. The invention set forth in claim 6 wherein said viewing unit is a video monitor controlled by a refresh memory and wherein said ROM output is mixed with said refresh memory output.

8. In a system for communicating information from an input source to a visual display terminal, said system having the characteristic that the momentary generation of said input information produces an output display representative of said input information, said output display remaining visible at the display terminal until actively removed under control of said input source, characterized in that there is provided means for providing at said display terminal first and second symbols graphically representative of the fact that information is being generated or removed, respectively, by said input source, said graphical symbols each being independent from the information content of said generated or removed input and being positionally dependent upon said generated or removed input.

9. The invention set forth in claim 8 further characterized in that said arrangement including means for automatically removing said graphical symbols from said display terminal after the conclusion of said generation or removal of said information by said input source.

10. The invention set forth in claim 8 wherein said graphic generating means includes a read only memory (ROM), the bit patterns of which are used to form said graphic image.

11. The invention set forth in claim 10 wherein said viewing unit is a video monitor controlled by a refresh memory and wherein said ROM output is mixed with said refresh memory output.

12. The invention set forth in claim 9 wherein said generating means includes means for selectively removing said provided graphic images when images on said viewing unit are unchanging, said means being operable to remove said second image immediately upon the cessation of said erasing and operable to remove said first image a fixed time interval after the cessation of said writing.

13. In a system for communicating information from an input terminal to a visual display terminal, said system having the characteristic that the momentary generation of said input information produces a visual output display representative of said input information, said output display remaining visible at the display terminal until actively removed under control of the input terminal, characterized in that there is provided an arrangement for providing at said visual display terminal a symbol graphically representative of the fact that information is being generated at said input terminal, said graphical symbol being independent from the information content of said generated input and being positionally dependent upon said generated input, said arrangement including means for automatically removing said graphical symbol from said display terminal after the conclusion of said generation of said information at said input terminal, and said arrangement including means for providing different graphical symbols depending upon whether information is being generated or removed from said input terminal.

14. The invention set forth in claim 13 wherein said generating means includes means for selectively removing said provided graphic images when images on said viewing unit are unchanging, said means being operable to remove said second image immediately upon the cessation of said erasing and operable to remove said first image a fixed time interval after the cessation of said writing.

15. The method of providing images on a viewing screen, said images representative of information transmitted from a sending unit, said method comprising the steps of receiving transmitted data representative of the location on said viewing screen of changed data, sequentially and repetitively providing said received data to said viewing screen, generating an overlay image, mixing said generated overlay image with said provided data to said viewing screen so that said generated overlay image is positioned with respect to a determined location of said last changed data.

16. The invention set forth in claim 15 further comprising the step of removing from said viewing screen said generated overlay image when said received data is unchanging.

17. The invention set forth in claim 15 further comprising the step of determining if said received data represents an addition or a subtraction of information from said sending unit, and wherein said generating step includes the generation of first and second overlay images controlled by whether said changed data is determined to represent said addition or subtraction, respectively.

18. The method of providing cursor images in a telautograph system having a sending unit and a separate viewing unit for observing images created on said sending unit, characterized in that said method includes the steps of generating separate from said drawn images distinctive graphic images, and selectively enabling one of said generated graphic images so as to provide a selected one of said graphic images to said viewing unit at the position on said viewing unit corresponding to where images created on said sending unit are being changed.

19. The invention set forth in claim 18 further comprising the step of removing from said viewing screen said generated overlay image when said received data is unchanging.

20. The invention set forth in claim 19 further comprising the step of determining if said received data represents an addition or a subtraction of information from said sending unit, and wherein said generating step includes the generation of first and second images controlled by whether said changed data is determined to represent said addition or subtraction, respectively.

21. The invention set forth in claim 18 further comprising the step of determining as between two sending units the currently active sending unit, and selecting a particular one of said generated graphic images depending upon the determined sending unit.

* * * * *